US011545784B2

(12) United States Patent
Grabichler et al.

(10) Patent No.: US 11,545,784 B2
(45) Date of Patent: Jan. 3, 2023

(54) COAXIAL RF CONNECTOR

(71) Applicant: SPINNER GmbH, Munich (DE)

(72) Inventors: Andreas Grabichler, Bruckmühl (DE); Wolfgang Zissler, Westerham (DE); Christoph Neumaier, Baiern (DE)

(73) Assignee: SPINNER GmbH, Munich (DE)

( * ) Notice: Subject to any disclaimer, the term of this patent is extended or adjusted under 35 U.S.C. 154(b) by 0 days.

(21) Appl. No.: 17/676,416

(22) Filed: Feb. 21, 2022

(65) Prior Publication Data

US 2022/0181821 A1 Jun. 9, 2022

Related U.S. Application Data

(63) Continuation of application No. PCT/EP2020/065844, filed on Jun. 8, 2020.

(30) Foreign Application Priority Data

Aug. 22, 2019 (EP) ..... 19193014.8

(51) Int. Cl.
*H01R 13/629* (2006.01)
*H01R 24/44* (2011.01)
*H01R 103/00* (2006.01)

(52) U.S. Cl.
CPC ..... *H01R 13/629* (2013.01); *H01R 24/44* (2013.01); *H01R 2103/00* (2013.01)

(58) Field of Classification Search
CPC .... H01R 2103/00; H01R 24/40; H01R 24/50; H01R 9/0521; H01R 24/44; H01R 13/629
USPC ..... 439/63, 578–585
See application file for complete search history.

(56) References Cited

U.S. PATENT DOCUMENTS

| | | | | |
|---|---|---|---|---|
| 6,758,680 | B2 * | 7/2004 | Duquerroy | H01R 24/50 439/63 |
| 9,033,730 | B2 * | 5/2015 | Lu | H01R 24/38 439/578 |
| 9,236,694 | B2 | 1/2016 | Binder et al. | |
| 2014/0322970 | A1 | 10/2014 | Binder et al. | |

FOREIGN PATENT DOCUMENTS

| | | | |
|---|---|---|---|
| CN | 103117469 | A | 5/2013 |
| CN | 204424523 | U | 6/2015 |
| EP | 1289076 | A2 | 3/2003 |
| JP | H05205813 | A | 8/1993 |

(Continued)

OTHER PUBLICATIONS

European Patent Office, Extended Search Report, Application No. 19193014.8, dated Feb. 7, 2020, 5 pages.

(Continued)

*Primary Examiner* — Gary F Paumen
(74) *Attorney, Agent, or Firm* — Quarles & Brady LLP; Yakov S. Sidorin

(57) ABSTRACT

A coaxial RF connector with inner and outer conductors has an outer conductor with a plurality of longitudinal slits forming a plurality of spring loaded contact elements. A contact sleeve is arranged movable in axial direction surrounding coaxially the outer conductor. The contact sleeve has a radial contact face which is in contact with the spring loaded contact elements and an axial contact face which has a plane orthogonal to the center axis of the connector for contacting a counter connector.

20 Claims, 6 Drawing Sheets

(56) References Cited

FOREIGN PATENT DOCUMENTS

| | | | |
|---|---|---|---|
| JP | 2002252066 | A | 9/2002 |
| JP | 2010257936 | A | 11/2010 |
| JP | 2015018741 | A | 1/2015 |
| WO | 2010007809 | A1 | 1/2010 |

OTHER PUBLICATIONS

PCT International Search Report and Written Opinion, PCT/EP2020/065844, dated Feb. 25, 2021, 10 pages.
National Intellectual Property Administration, PRC, First Office Action and Search Report, Application No. 202080059360.2, dated Aug. 1, 2022, 11 pages [English Language Translation Only].
Japan Patent Office, Notification of Reasons for Refusal, Application No. 2022-511341, dated Sep. 6, 2022, 8 pages.
Korean Intellectual Property Office, Request for the Submission of an Opinion, Application No. 10-2022-7009123, dated Oct. 20, 2022, 13 pages.

* cited by examiner

COAXIAL RF CONNECTOR

CROSS-REFERENCE TO RELATED APPLICATIONS

This application is a continuation of pending International Application No. PCT/EP2020/065844 filed on Jun. 8, 2020 and now published as WO 2021/032333, which designates the United States and claims priority from European Application No. 19193014.8 filed on 22 Aug. 2019. The disclosure of each of the above-identified patent documents is incorporated herein by reference.

BACKGROUND

1. Field of the Invention

The invention relates to a coaxial connector for radio frequencies (RF), which may be a miniature connector.

2. Description of Related Art

U.S. Pat. No. 9,236,694 B2 discloses a coaxial connector system designed for low passive intermodulation. A plug connector has a spring-loaded outer connector for contacting the solid side wall of a socket connector. Due to a precision contact de-sign and high contacting forces between the plug connector and the second connector, a low passive intermodulation is achieved.

This spring loaded outer connector can hardly be miniaturized to very small connector sizes which are required for frequencies in a range above 20 GHz.

SUMMARY

The problem to be solved by the invention is to provide a coaxial RF connector having an outer conductor Furthermore, the RF connector may be miniaturized, for example. An outer connector may have a diameter in a range of less than 2 mm. The connector should be robust and should have a service life of more than 1000 cycles.

In an embodiment, a coaxial RF connector, which may be a plug connector, a socket connector, or a hermaphroditic connector, has a housing, a center conductor and an outer conductor. The center conductor defines by its center a center axis of the connector. The outer conductor is arranged coaxially around the center conductor and may hold the center conductor by at least one strut including insulation material. A connector housing may be a part of the outer conductor. There may be at least one means configured to mechanically fasten a plug connector to a socket connector or two hermaphroditic connectors together.

A first embodiment relates to such a coaxial RF connector. The outer conductor may have a tubular shape with a plurality of slits in a longitudinal direction parallel to the center axis. The slits may have a length in a range between 0.2- to 5-times the diameter of the outer conductor. The slits may extend to an end or an end face of the outer conductor. This end may be oriented to a contact side of the connector. A counter connector may be connected at the contact side configured to make an electrical connection. There may be any number of slits between 2 and 50, preferably between 4 and 8. The outer conductor together with the slits forms a plurality of spring-loaded contact elements. These contact elements produce a counterforce if a force is applied in a radial direction with respect to the center axis.

A contact sleeve is provided which surrounds coaxially the outer conductor at a location where the spring-loaded contact elements are located. The contact sleeve has a tubular shape and is movable in a direction parallel to the center axis. The contact sleeve further has a radial contact face which is in contact with the spring-loaded contact elements. As the spring-loaded contact elements have a circular outer contour from the outer conductor, the contact sleeve may have a circular inner contour matching thereto. The inner diameter of the contact sleeve may be adapted such that a predetermined radial pressure is asserted on the spring-loaded contact elements to obtain a predetermined contact force.

The contact sleeve further has an axial contact face, which has a plane orthogonal to the center axis. Normally, this plane may be outside of the outer contact end face, such that the axial contact face contacts a counter connector. The outer conductor itself with its outer conductor end face may not contact the counter connector.

To hold the contact sleeve in position and to provide a predetermined contact pressure to a counter connector, a spring element is provided. The spring element may be a metal spring, e.g. a coil spring or it may include an elastomer material. Such a spring element may be a rubber or elastomer O-shaped ring. The spring element may press against the contact sleeve into a direction of the center axis parallel to the center axis and outward of the connector.

In an alternate embodiment, the spring element may be one part with the contact sleeve. The contact sleeve may include a slotted body further including flexible sections with slots between the sections. There may be a contact section configured to contact the counter connector outer conductor. The contact sleeve may be an integrated part, where the contact section may have the function of the contact sleeve in the previous embodiments. The slotted body may have the function of the spring element. The contact sleeve may have an end section opposing to the contact section. The end section may be held by the connector housing and may also be in contact with an outer conductor matching to an inner conductor. To simplify assembly, there may be an outer conductor sleeve which ends with spring loaded contact elements. This outer conductor sleeve may be in contact with the outer conductor, e.g. by a soldering or welding connection. It may also be pressed by the contact sleeve against the outer conductor.

To ensure a proper electrical contact, it may be desired to hold the connector in a fixed position relative to the counter connector, to which the connector should be coupled or mated to transfer electrical signals or power. The connector may be held by a connector housing which may include further attachment components or by a larger unit, for example a transmitter housing into which the connector is integrated.

In an embodiment, the coaxial connector includes a locking sleeve which may be coaxial to the outer conductor. The locking sleeve may include a locking hook structure configured to hold a counter connector. The locking sleeve may have slits in a direction parallel to the center axis, such that it forms a plurality of locking hooks which may be bent outwards and configured to engage and/or release a counter connector. To release the locking hook structure, there may be a pull sleeve which may further include an actuating ring. This actuating ring may interact with the locking hook structure and press the locking hook structure which may include of a plurality of locking hooks, which may be circularly arranged in a radial direction outward, such that a counter connector may be released.

In a further embodiment, the coaxial RF connector may include a locking nut which may be held by the housing or the outer conductor. The locking nut may have an inner thread which may engage with an outer thread of a counter connector, such that the connector may be locked to the counter connector by rotating the nut and engaging the threads.

In a further embodiment, the outer conductor has a reinforced section which may be distant from the slits and oriented away from the outside or contacting side of the connector. This reinforced section may enhance stability of the outer conductor and the connector. It may further provide means configured to hold a connector housing. Furthermore, the reinforced section may provide support for the spring element. It may have an edge configured to support the spring element such that the spring element is arranged between the edge and the contact sleeve. The reinforced section may also hold the locking sleeve in position. The reinforced section may have a cylindrical outer shape. It may have further protrusions or recesses configured to hold the locking sleeve. It may hold the locking sleeve in a radial direction relative to the center axis.

The spring-loaded contact elements may have a contact element protrusion which may be oriented in a radial direction and which may interface with a contact sleeve protrusion to limit an axial movement of the contact sleeve preferably in an outward direction. In an unconnected state of the connector, the spring element presses the contact sleeve in an outward direction of the connector. If the outward movement is limited by the two interfacing protrusions, the contact sleeve cannot fall off the connector.

In an embodiment, the axial contact face extends beyond the outer conductor end face. This may allow a tilt angle between the nominal plane orthogonal to the inner conductor, defined by the end plane and the mating face where the counter connector touches the connector. This may also allow tilting the connector relative to the counter connector.

In an embodiment, the coaxial RF connector is a plug connector and it includes a contact pin at the inner conductor.

A further embodiment relates to a coaxial RF connector system, which may include a coaxial RF connector as described herein and a coaxial RF counter connector which matches to the coaxial RF connector. The coaxial RF connector and the coaxial RF counter connector may be mated together to form an electrical connection.

The RF counter connector may include a counter connector inner conductor defining a center axis of the connector, and counter connector outer conductor which is arranged coaxially to the counter connector inner conductor. Preferably, the counter connector outer conductor has a tubular shape, which further has a counter connector outer conductor end face. The counter connector outer conductor end face may have a circular outer contour and a size adapted to match to the axial contact face of the contact sleeve. Preferably, the complete axial contact face may enter into contact with the counter connector outer conductor end face. There may be a gap between the outer conductor of the coaxial connector and the counter connector outer conductor end face. There may be only a single electrical current path from the coaxial connector outer conductor via the spring-loaded contact elements into the contact sleeve. The current may further flow through the contact sleeve and leave the contact sleeve through the axial contact face into the counter connector outer conductor end face.

This embodiment provides a significantly more precise and reliable outer connector contact, even, if there is a minor misalignment between the connectors. Such a misalignment may be compensated by the contact sleeve.

In an embodiment, the coaxial RF counter connector may include a locking ring. The locking ring may have a protrusion which may interface with the locking sleeve of the coaxial RF connector to hold both connectors together.

Between the coaxial RF connector and the coaxial RF counter connector, there may be only one combined mechanical and electrical contact in an axial direction (a direction parallel to the center axis). This connection is between the locking sleeve and the counter connector outer conductor end face. With respect to the outer connector of the coaxial RF connector and its housing, a force may be applied to the contact sleeve. This is basically the same force, but in the opposite direction, which has to be maintained between the locking ring and the locking hook structure of the locking sleeve.

In a further embodiment, the pull sleeve of the coaxial RF connector may include a cylindrical centering face which may correspond to the interior of a hollow cylinder. This centering face may match to a centering ring of the coaxial RF counter connector. The centering ring may include a thread, preferably at its outer surface. When mated, the centering face contacts the centering ring, which are both concentrically aligned with the center axis such that both connectors are also aligned concentrically with the center axis.

In a further embodiment, both the centering face and the centering ring have a length that is sufficient to prevent tilting between the connectors and to prevent an additional load by tilting on the contact system.

In a further embodiment, the RF counter connector may include a locking thread which may match to a locking nut of the coaxial RF connector as described above.

In a further embodiment, the coaxial RF counter connector may be a socket connector and includes a counter connector inner conductor contact socket which is at the end of the counter connector inner conductor and mates with the inner conductor contact pin.

In general, the plug and socket configuration may be reversed or a hermaphroditic connector configuration may be used for the inner conductor. This has no or only a negligible influence on the outer conductor configuration disclosed herein.

In an embodiment, a coaxial RF connector is a connector configured to electrically connect RF lines and to couple radio frequency (RF) signals. An outer conductor is arranged coaxially around an inner conductor. For coupling such RF signals, the connector must have a predetermined characteristic impedance which may be 50 Ohm. The connector must also have low insertion losses and low return losses. This requires beyond a high conductivity, a coaxial RF connector to have a conductor structure which maintains the characteristic impedance over the full length of the connector with minimal deviations. This means that essentially the capacitance must be constant over the full length of the connector. Therefore, at each point of the conductor structure, a certain relation between the diameter of the inner conductor and the distance between outer conductor and inner conductor must be maintained. Here, also the dielectric constant of a material between the inner conductor and the outer conductor must be considered.

Coaxial HV (high voltage) connectors are in most cases not suitable for RF signals. Such HV connectors provide a symmetrical, coaxial structure to maintain an even field distribution, but it is not essential to have a certain characteristic impedance and further to maintain such a characteristic impedance constant over the full length of the connector. Therefore, the design of HV connectors is less critical.

BRIEF DESCRIPTION OF THE DRAWINGS

In the following, the invention will be described by way of example, without limitation of the general inventive concept, on examples of embodiment and with reference to the drawings.

Figure 1:
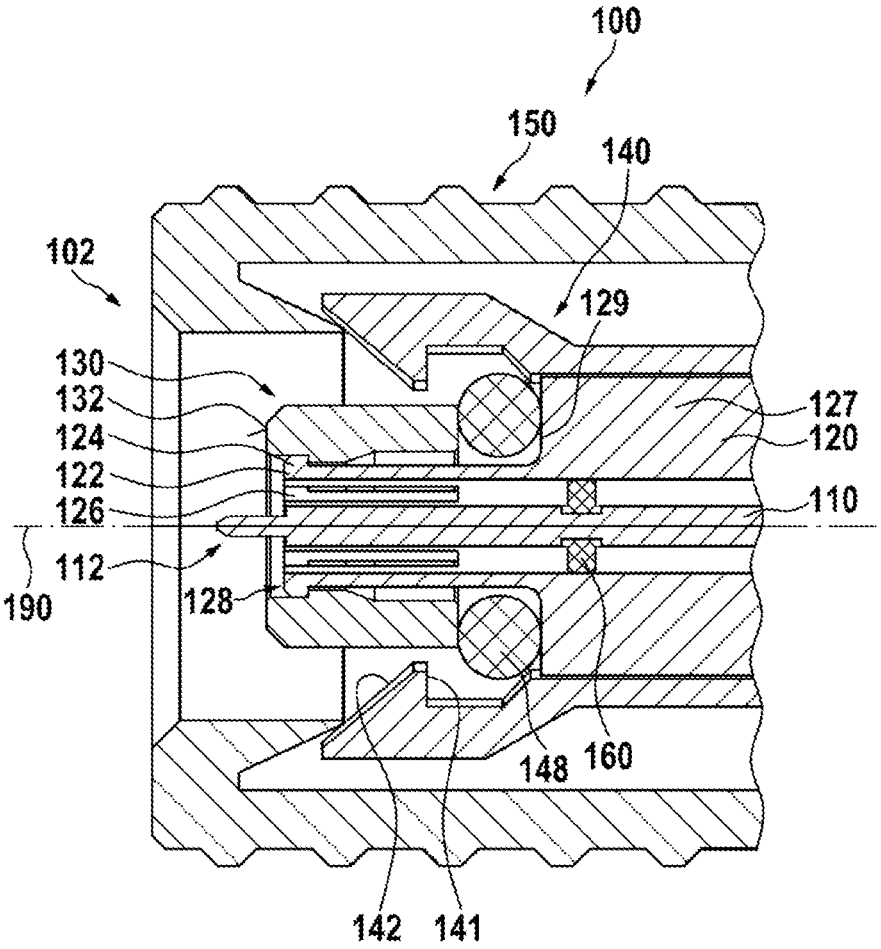
FIG. 1 shows a first embodiment of a connector.

Generally, the drawings are not to scale. Like elements and components are referred to by like labels and numerals. For the simplicity of illustrations, not all elements and components depicted and labeled in one drawing are necessarily labels in another drawing even if these elements and components appear in such other drawing.

While various modifications and alternative forms, of implementation of the idea of the invention are within the scope of the invention, specific embodiments thereof are shown by way of example in the drawings and are described below in detail. It should be understood, however, that the drawings and related detailed description are not intended to limit the implementation of the idea of the invention to the particular form disclosed in this application, but on the contrary, the intention is to cover all modifications, equivalents and alternatives falling within the spirit and scope of the present invention as defined by the appended claims.

DETAILED DESCRIPTION

In FIG. 1, a first embodiment of a coaxial RF connector 100 is shown. The coaxial RF connector 100 has a contact side 102—to the left of the figure—to which a counter connector (not shown) may be connected. The coaxial RF connector 100 has an inner conductor 110 and arranged coaxially thereto an outer conductor 120. The inner conductor 110 defines a center axis 190. In this embodiment, the inner conductor is part of a male connector and therefore has an inner conductor contact pin contact pin 112. The inner conductor may be supported within the outer conductor by at least one strut 160.

The outer conductor has an outer conductor end face 122 at the end of the outer conductor and oriented towards the contact side 102. The outer conductor further has a plurality of longitudinal slits 126 extending from the outer conductor end face. The remaining material between these slits form spring-loaded contact elements which may produce a contact force in a radial direction with respect to the center axis 190. At the end of the spring-loaded contact elements 128 and aligned with the outer conductor end face 122 are contact element protrusions 124 configured to contact sleeve 130. Contact sleeve 130 is mounted coaxially with the outer conductor 120. Contact sleeve 130 may be movable parallel to the center axis and it is mechanically preloaded by a spring element 148 which may be a metal spring or an elastomeric material, such as rubber or similar. It may also be an O-shaped rubber ring. This rubber ring may act against a reinforced section 127 of the outer conductor.

The components previously described are sufficient to provide an electrical contact to a wide variety of counter connectors. The electrical contact between the outer conductor 120 to the outer connector of a counter connector may be made via the contact sleeve 130. First, the spring-loaded contact elements 128 of outer conductor 120 contact the contact sleeve 130 which further contacts with an axial contact face 132 the outer conductor of the counter connector. Therefore, there may be only a contact in an axial direction, but not in a radial direction. Furthermore, the spring-loaded contact elements 128 do not contact the outer conductor of the counter connector. Instead they are only designed to contact the contact sleeve 130. Finally, the inner conductor 110 contacts the counter connector by means of the inner conductor contact pin 112.

There may be a plurality of mechanical components to achieve a proper mechanic connection configured to mate with a counter connector. The specific shape of these mechanical components may vary and they may be adapted to the specific needs of the counter connector. In this embodiment, a locking sleeve 140 may be provided which has a locking hook structure 141 providing a plurality of locking hooks. A minimum of two locking hooks are required, but three or more locking hooks are preferred. The locking hook structure may have a slanted edge 142 configured to interface with a pull sleeve which may also be arranged coaxially to the outer conductor. The pull sleeve may have means configured to bend the locking hooks outward to release a counter connector held by the locking hooks.

Figure 2:
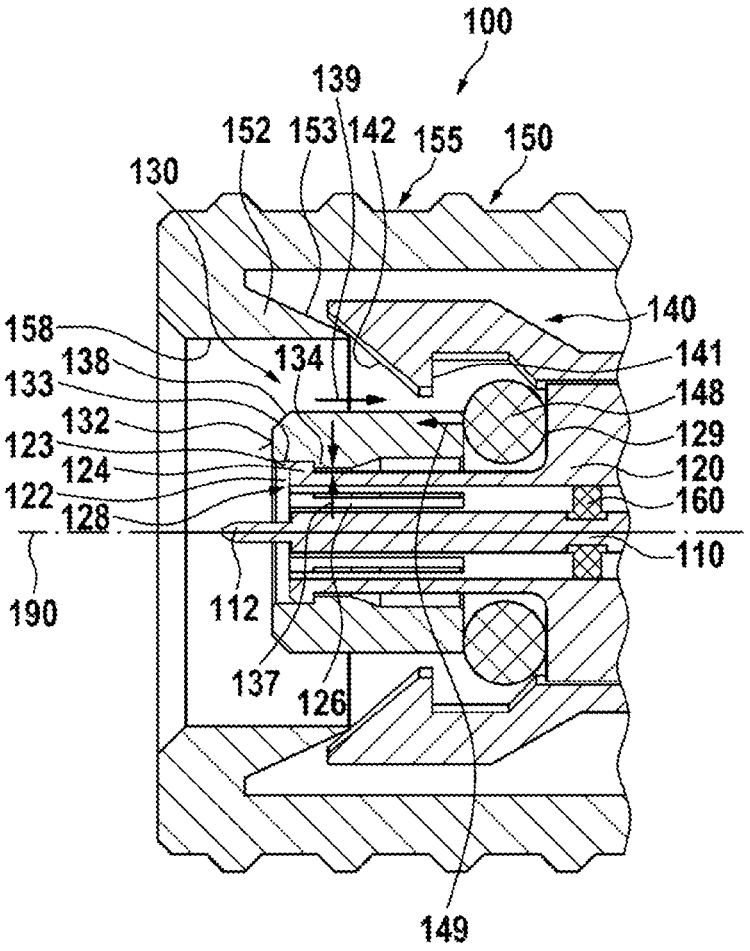
FIG. 2 shows a detailed view of FIG. 1.

In FIG. 2, a detailed view of FIG. 1 is shown. It is shown that the contact sleeve 130 only contacts the spring-loaded contact elements 128 at a radial contact face 133. Outside of the contact area, there may be a minimum gap 137 between the outer conductor and the contact sleeve. This gap may allow a minimal movability of the sleeve without contacting the outer conductor and therefor ensures only a single contact area between the outer conductor and the contact sleeve. The contact sleeve may have a contact sleeve protrusion 134 which may interact with the contact element protrusion 124 to limit the axial movement of the contact sleeve and therefore to prevent the contact sleeve from falling off the outer conductor, for example when the connector is disconnected.

In the embodiment shown herein, the contact sleeve 130 may be in an outmost position and may be moved inwards as shown by arrow 139 when a counter connector is mated. This movement may be against a counterforce 149 generated by the spring element 148. The contact sleeve may have a chamfered edge 138 at the outer circumference and/or at the inner circumference.

FIG. 2 also shows details of the interaction between the pull sleeve 150 and the locking sleeve 140. The slanted edge 142 of locking sleeve 140 may allow to insert a counter connector from the left side into a direction which is also indicated by arrow 139. Such a counter connector may have a locking ring 240 with a locking ring protrusion 242, as will be shown in the next Figure. This protrusion may then move along the slanted edge 142, thereby pressing the locking hook structure 141 outwards until it may be behind the locking hook structure 141 and the locking hook structure 141 goes back locking the locking ring protrusion 242 in its position. To unlock the connector, the pull sleeve 150 may be pulled back into the same direction as indicated by arrow 139. The pull sleeve 150 may have an actuating ring 152 providing at least one actuating edge 153. Such an actuating edge 153 may pass along slanted edge 142 of the locking sleeve and therefore press locking hook structure 141 outwards, releasing the locking ring protrusion 242 of the counter connector.

To simplify handling, actuating ring 152 may have gripping grooves 155.

Figure 3:
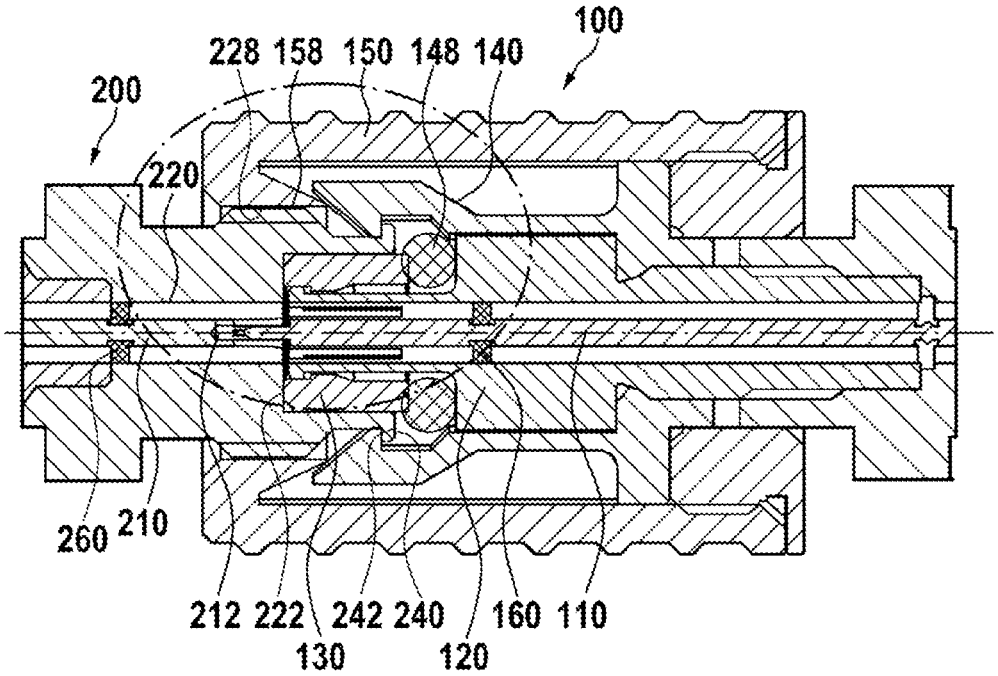
FIG. 3 shows a connector mated with a counter connector.

In FIG. 3, a coaxial RF connector 100 is shown in a state mated with a coaxial RF counter connector 200. In this state, the contact sleeve 130 may be pressed backwards (in the direction indicated by arrow 139 in FIG. 2) by the counter connector outer conductor end face 222. At the same time, the spring element 148 may be compressed. The inner conductor contact pin 112 of coaxial RF connector 100 mates with counter connector inner conductor contact socket 212 of coaxial RF counter connector 200. The counter connector inner conductor 210 may be held by counter connector struts 260 within the counter connector outer conductor 220.

Centering of the two connectors may be achieved by a centering face 158 of the pull sleeve 150 mating with a centering ring 228 of the coaxial RF counter connector 200. The centering ring may include a thread, preferably at its outer surface. The overlapping of the centering face and the centering ring may be long enough to prevent tilting of the connectors against each other.

Figure 4:
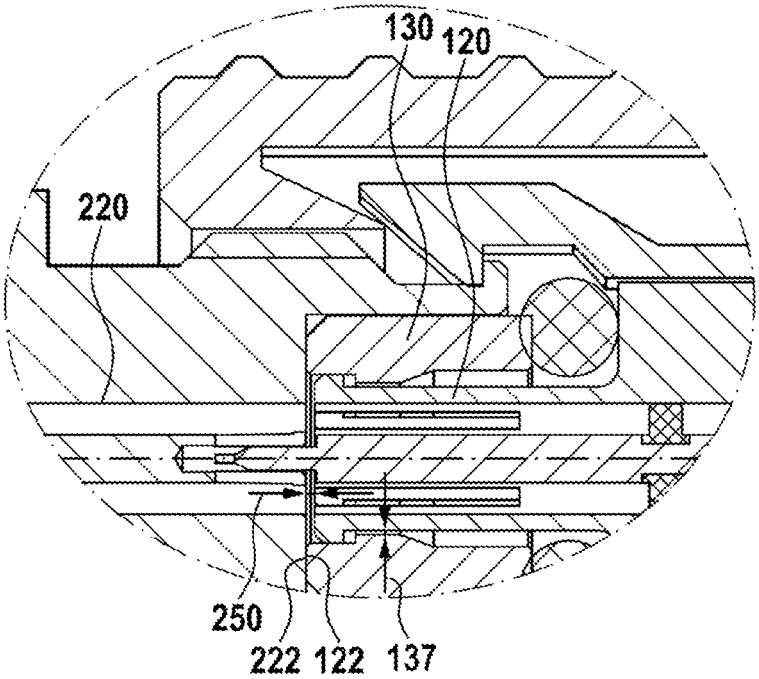
FIG. 4 shows a detail of the previous Figure.

In FIG. 4, a detail of the previous Figure is shown. As mentioned before, a gap 250 between the outer conductor end face 122 and counter connector outer conductor end face 222 may be formed. This gap may prevent a direct galvanic contact between the two end faces. Outside of the contact area, there may be a minimum gap 137 between the outer conductor 120 and the contact sleeve 130. This gap may allow a minimal movability of the sleeve without contacting the outer conductor and therefor ensures only a single contact area between the outer conductor and the contact sleeve.

Figure 5:
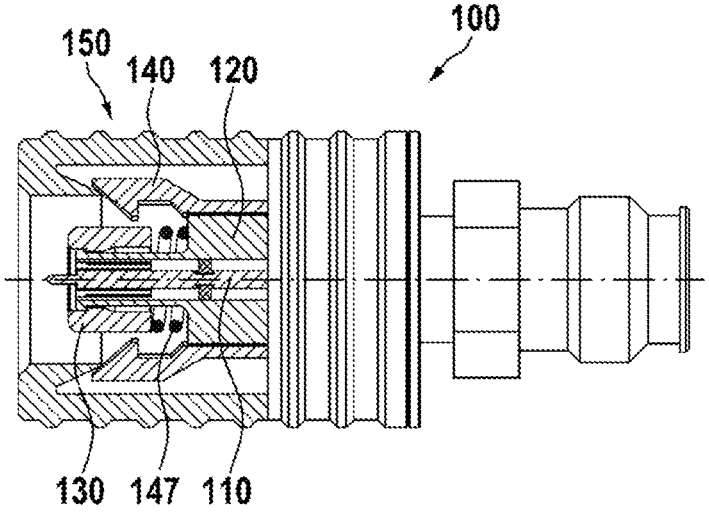
FIG. 5 shows a coaxial RF connector 100 with a coil spring.

In FIG. 5, a coaxial RF connector 100 is shown with a coil spring 147 as spring element. A coil spring may provide a longer lifetime and a more predictable and constant force compared to a polymer component. The right portion of the figure without reference signs may be a cable adapter or a further connector or any other coaxial part. It is not relevant for the embodiments shown herein.

Figure 6:
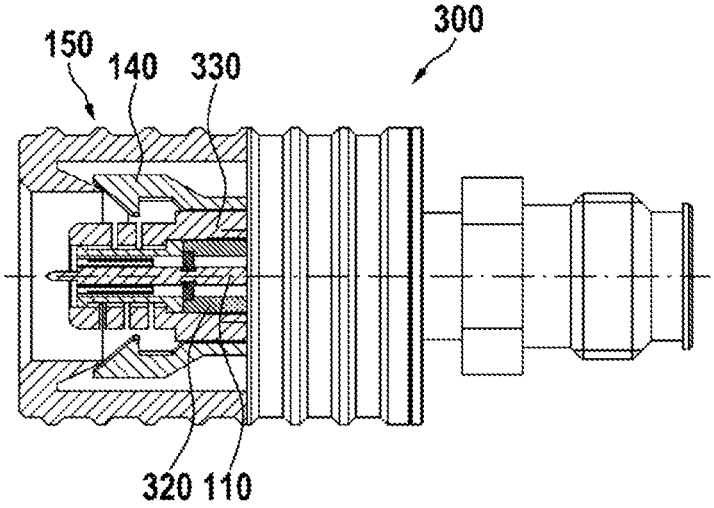
FIG. 6 shows a further embodiment with a modified contact sleeve.

In FIG. 6, a further embodiment of a coaxial RF connector 300 is shown.

Here a modified contact sleeve 330 is provided. The spring element may be one part with the contact sleeve.

Figure 7:
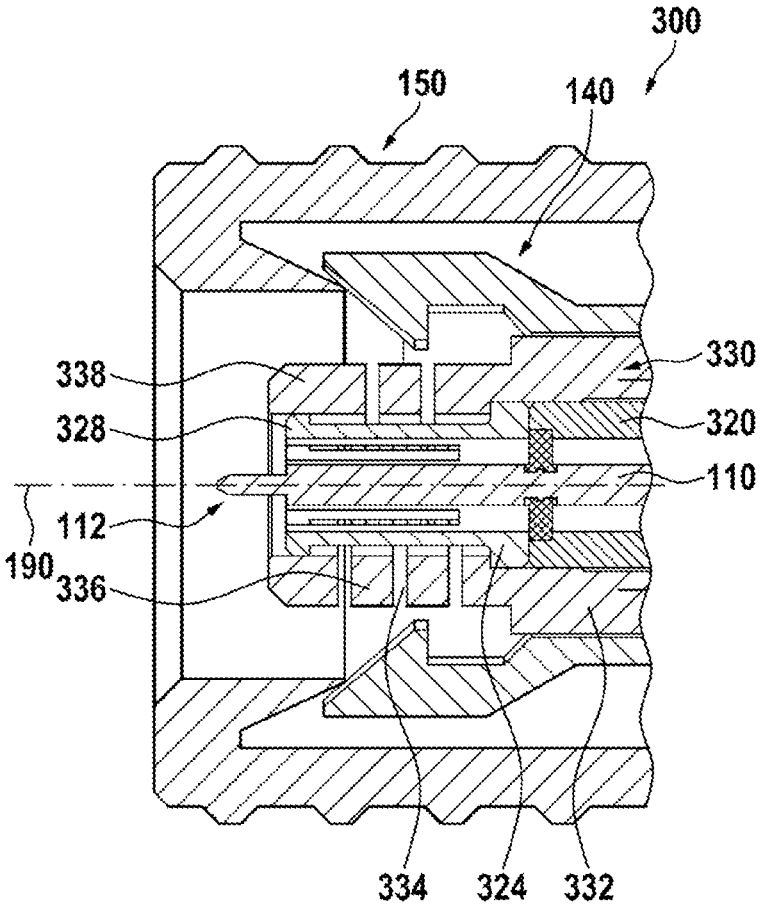
FIG. 7 shows a more detailed view of FIG. 6.

FIG. 7 shows a more detailed view of the previous figure. The contact sleeve 330 includes a slotted body including flexible sections 336 with slots 334 between the sections and with a contact section 338 having an axial contact face 132 which has a plane orthogonal to the center axis 190. The axial contact face 132 may be configured to contact a counter connector outer conductor. Here, the contact sleeve 330 may be an integrated part, where the contact section 338 has the function of the contact sleeve 130 in the previous embodiments. The slotted body has the function of the spring element. The contact sleeve may have an end section 332 opposing to the contact section 338. The end section 332 may be held by the connector housing and may also be in contact with an outer conductor 320 matching to inner conductor 110. To simplify assembly, there may be an outer conductor sleeve 324 which ends with spring loaded contact elements 328. This outer conductor sleeve 324 may be in contact with the outer conductor 320, e.g. by a soldering or welding connection. It may also be pressed by the contact sleeve 330 against the outer conductor 320.

Figure 8:
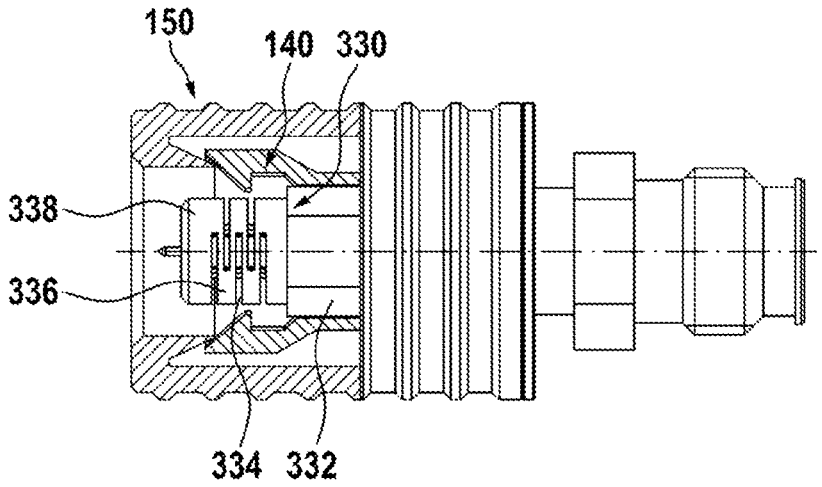
FIG. 8 shows the previous embodiment, but with uncut contact sleeve.

FIG. 8 shows the previous embodiment, but with uncut contact sleeve 330, such that the slots 334 can be better seen. There may be displaced slots in opposing directions as shown, but there may also be a spiral cut, providing a coil spring like shape.

Figure 9:
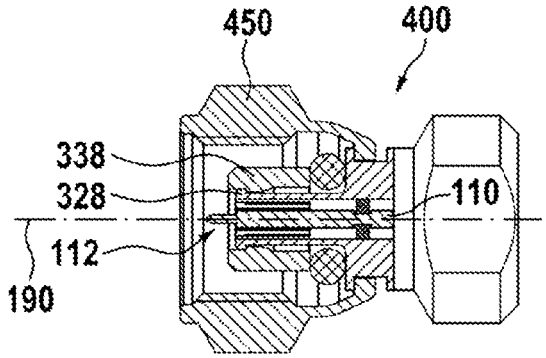
FIG. 9 shows a further embodiment of a coaxial RF connector.

In FIG. 9, a further embodiment of a coaxial RF connector 400 is shown having a locking nut 450 which replaces the previously shown pull sleeve 150 and the locking sleeve 140.

It will be appreciated to those skilled in the art having the benefit of this disclosure that this invention is believed to provide a coaxial RF connector. Further modifications and alternative embodiments of various aspects of the invention will be apparent to those skilled in the art in view of this description. Accordingly, this description is to be construed as illustrative only and is provided for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

100 coaxial RF connector
102 contact side
110 inner conductor
112 inner conductor contact pin
120 outer conductor
122 outer conductor end face
123 chamfered edge
124 contact element protrusion
126 longitudinal slit
127 reinforced section
128 spring loaded contact element
129 edge
130 contact sleeve
132 axial contact face
133 radial contact face
134 contact sleeve protrusion
138 chamfered edge
139 movement of contact sleeve
137 gap
140 locking sleeve
141 locking hook structure
142 slanted edge
147 coil spring
148 spring element
149 force to contact sleeve
150 pull sleeve
152 actuating ring
153 actuating edge
155 gripping grooves
158 centering face
160 strut
190 center axis
200 coaxial RF counter connector
210 counter connector inner conductor

212 counter connector inner conductor contact socket
220 counter connector outer conductor
222 counter connector outer conductor end face
228 centering ring
240 locking ring
242 locking ring protrusion
250 gap
260 counter connector strut
300 coaxial RF connector with modified contact sleeve
324 outer conductor sleeve
328 spring loaded contact element
332 end section
334 slot
336 flexible sections
338 contact section
400 coaxial RF connector with locking nut
450 locking nut

The invention claimed is:

1. A coaxial RF connector system comprising at least
a coaxial RF connector, and
a coaxial RF counter connector;
wherein the coaxial RF connector includes
an inner conductor defining a center axis of the coaxial RF connector,
an outer conductor coaxial with the inner conductor, the outer conductor having a tubular shape and having a plurality of longitudinal slits that extend to an end face of the outer conductor and that form a plurality of spring loaded contact elements,
a contact sleeve surrounding coaxially the outer conductor and having a radial contact face that is in contact with the spring loaded contact elements of the outer conductor,
wherein the contact sleeve is movable in a direction parallel to the center axis and has an axial contact face that has a plane orthogonal to the center axis,
the contact sleeve has an axial contact face that has a plane orthogonal to the center axis,
and
a spring element in contact with the contact sleeve to assert a force on the contact sleeve in a direction parallel to the center axis and outward of the connector;
wherein the coaxial RF counter connector includes
a counter connector inner conductor defining a center axis of the counter connector, and
a counter connector outer conductor coaxial with the counter connector inner conductor;
wherein the counter connector outer conductor and the contact sleeve are dimensioned such that, when the coaxial RF connector and the coaxial RF counter connector are mated, the counter connector outer conductor radially surrounds and is in contact with the contact sleeve.

2. A coaxial RF connector system according to claim 1, wherein:
the coaxial RF connector comprises a locking sleeve coaxial with the outer conductor,
the locking sleeve further comprises a locking hook structure, and
the coaxial RF connector further comprises a pull sleeve that contains an actuating ring configured to release the locking hook structure.

3. A coaxial RF connector system according to claim 1, further comprising a locking nut.

4. A coaxial RF connector system according to claim 1, wherein
(4a) the spring element is an O-shaped ring comprising an elastomeric material, or
(4b) the spring element is a coil spring.

5. A coaxial RF connector system according to claim 1, further comprising a locking sleeve coaxial with the outer conductor, wherein the outer conductor has a reinforced section that forms an edge,
wherein
(5a) the edge supports the spring element such that the spring element is arranged between the edge and the contact sleeve and/or
(5b) the reinforced section holds the locking sleeve in a radial direction relative to the center axis.

6. A coaxial RF connector system according to claim 1, wherein the spring loaded contact elements have a contact element protrusion that interfaces with a contact sleeve protrusion of the contact sleeve to limit an axial movement of the contact sleeve in an outward direction.

7. A coaxial RF connector system according to claim 1, wherein the contact sleeve comprises a slotted body further comprising flexible sections with slots between the sections and a contact section, the contact section having an axial contact face that has a plane orthogonal to the center axis.

8. A coaxial RF connector system according to claim 1, wherein
the coaxial RF connector is a plug connector and comprises an inner conductor contact pin.

9. A coaxial RF connector system according to claim 1, wherein the axial contact face extends beyond the outer conductor end face.

10. A coaxial RF connector system according to claim 1, wherein the counter connector outer conductor has a tubular shape with a counter connector outer conductor end face.

11. A coaxial RF connector system according to claim 1, wherein, when the RF connector and the RF counter connector are mated,
the radial contact face of the contact sleeve is in contact with the counter connector outer conductor end face of the coaxial RF counter connector.

12. A coaxial RF connector system according to claim 1, wherein, when the RF connector and the RF counter connector are mated, a gap exists between the outer conductor end surface of the coaxial RF connector and the counter connector outer conductor end face of the coaxial RF counter connector.

13. A coaxial RF connector system according to claim 1, wherein the coaxial RF connector comprises a locking sleeve coaxial with the outer conductor, and the locking sleeve further comprises a locking hook structure,
wherein the coaxial RF counter connector comprises a locking ring, which, when the RF connector and the RF counter connector are mated, interfaces with the locking hook structure.

14. A coaxial RF connector system according to claim 1, wherein the coaxial RF connector comprises a locking sleeve coaxial with the outer conductor, the locking sleeve further comprises a locking hook structure, and the coaxial RF connector further comprises a pull sleeve configured to release the locking hook structure,
wherein the pull sleeve of the coaxial RF connector comprises a cylindrical centering face which matches to a centering ring of the coaxial RF counter connector.

15. A coaxial RF connector system according to claim 1, wherein the coaxial RF counter connector is a socket connector and comprises a counter connector inner conductor contact socket.

16. A coaxial RF connector system according to claim 14, wherein the pull sleeve of the RF connector is configured to bend the locking hooks outwardly when moved along the center axis.

17. A coaxial RF connector comprising at least:

an inner conductor defining a center axis of the coaxial RF connector, and an outer conductor coaxial with the inner conductor, the outer conductor having a tubular shape and having a plurality of longitudinal slits that extend to an end face of the outer conductor and that form a plurality of spring loaded contact elements wherein:

a contact sleeve is arranged surrounding coaxially the outer conductor, the contact sleeve being movable in a direction parallel to the center axis, the contact sleeve has a radial contact face that is in contact with the spring loaded contact elements, the contact sleeve has an axial contact face that has a plane orthogonal to the center axis, and further comprising a spring element in contact with the contact sleeve to assert a force on the contact sleeve in a direction parallel to the center axis and outward of the connector wherein the contact sleeve comprises a slotted body further comprising flexible sections with slots between the sections and a contact section, the contact section having an axial contact face that has a plane orthogonal to the center axis.

18. A coaxial RF connector according to claim 17, wherein:

the coaxial RF connector comprises a locking sleeve coaxial with the outer conductor, the locking sleeve further comprises a locking hook structure, and the coaxial RF connector further comprises a pull sleeve that contains an actuating ring configured to release the locking hook structure.

19. A coaxial RF connector system comprising a coaxial RF connector according to claim 17 and a coaxial RF counter connector, wherein the coaxial RF counter connector comprises a counter connector inner conductor defining a center axis of the counter connector, and a counter connector outer conductor coaxial with the counter connector inner conductor, wherein the counter connector outer conductor has a tubular shape with a counter connector outer conductor end face.

20. A coaxial RF connector system according to claim 19, wherein the counter connector outer conductor and the contact sleeve are dimensioned such that, when the coaxial RF connector and the coaxial RF counter connector are mated, the counter connector outer conductor radially surrounds and is in contact with the contact sleeve.

* * * * *